United States Patent [19]

Affronti

[11] 4,184,160

[45] Jan. 15, 1980

[54] ANTENNA ROOF MOUNT FOR VEHICLES

[76] Inventor: Victor A. Affronti, 17 Norma La., Kings Park, N.Y. 11754

[21] Appl. No.: 886,674

[22] Filed: Mar. 15, 1978

[51] Int. Cl.[2] ..... H01Q 1/32

[52] U.S. Cl. ..... 343/712; 343/713

[58] Field of Search ..... 343/711, 713, 715, 846, 343/712

[56] References Cited

U.S. PATENT DOCUMENTS 3,729,741 4/1973 Otto ..... 343/713

*Primary Examiner*—Eli Lieberman

*Attorney, Agent, or Firm*—Richard L. Miller

[57] ABSTRACT

A roof mount for coupling an antenna to the roof of a vehicle and simultaneously providing a capacitive coupling for grounding the antenna to the vehicle frame. The antenna is supported by a housing which is connected to a base plate which in turn fits transversely across the roof of the vehicle. The ends of the base plate are clamped onto the edges of the roof to be firmly held in place. The base plate is separated from the metallic roof either by a vinyl roof top or by a layer of paint, depending upon the type of vehicle. The base plate is then capacitively coupled to the vehicle for providing a ground to the antenna. The roof mount can accommodate various sized antennas and various types of feed through cables depending upon the equipment to which the antenna is connected.

9 Claims, 5 Drawing Figures

ANTENNA ROOF MOUNT FOR VEHICLES

BACKGROUND OF THE INVENTION

This invention relates to antenna mountings and more particularly for a roof mount connecting the antenna to a vehicle.

Numerous types of transmitting and receiving equipment are carried in a vehicle and require the use of an antenna to receive and transmit the various signals. Most vehicles contain a radio which requires an antenna. If the radio includes FM, an improved type of an antenna is required which can clearly pick up the FM signals. Many vehicles also carry CB radios which also need long antennas for receiving and transmitting signals.

With improved type of equipment, additional types of transceiver equipment are also carried in the vehicle. At times, a complete amateur radio will be contained in the vehicle which also requires the use of a power antenna. Should the vehicle be used as the base station for a radio controlled airplane or other similar equipment, again an improved type of antenna is required on the vehicle.

The antennas which are mounted on the vehicle must be positioned to extend far enough above the vehicle so as to avoid interference by other vehicles and other surrounding buildings and environment blocks. In many situations, the antenna is connected to the trunk of the vehicle and extends upwardly from the trunk as high as possible to avoid such interference. Since the trunk is on a relatively lower portion of the vehicle, at least the lower part of the antenna must be utilized to overcome the interference of the vehicle itself. Therefore the antennas generally extending from the trunk or or hood of the vehicle are extremely tall. This presents a problem of supporting the antenna, preventing it from snapping off at fast speeds, avoiding its interferring with other vehicles and overhead trees and wires, and maintaining appropriate eletrical contact with the transceiver equipment in the car.

Another problem with existing types of antenna mounts concerns appropriate electrical connection between the antenna and the vehicle as well as the internal equipment. One cable is generally provided between the antenna and the transceiver for transmitting and receiving the signals between the equipment and the antenna. At the same time, the antenna must be grounded and generally a ground is provided on the vehicle itself. Therefore, the mounting bracket or clamp supporting the antenna onto the vehicle usually includes a conductive connection which provides the ground between the antenna and the vehicle. This has presented problems since it is often difficult to make direct electrical contact with the vehicle because of the paint, grease and other films frequently covering the exterior of the vehicle. As a result, holes are made into the vehicle through which the antenna extends and the antenna is inserted through the hole clamping it to the vehicle.

Once a puncture is made into the vehicle to receive the antenna, it becomes a permanent mark and if the antenna is removed there is a definite damage to the vehicle which is rather costly to repair. Additionally, as new equipment is manufactured, it is frequently desirous to change the type of antenna replacing an existing one with an improved type of antenna. However, the antennas vary in size, the feed through cables also vary, and a puncture or opening made into the vehicle will not always universally accommodate different sized antennas. In changing equipment it therefore frequently becomes necessary to make additional holes and damage to the car in order to receive the new type equipment.

There is accordingly a need for an improved type of mounting for connecting an antenna to a vehicle. The improved mounting should place the antenna in a suitable position which avoids interference with the vehicle itself as well as neighboring vehicles and buildings. This would generally necessitate placing the antenna at the highest position of the vehicle itself. Also, the antenna mounting should be such as to ground the antenna without necessarily making holes into the vehicle itself. This would permit replacement or removal of the antenna without leaving a damaged vehicle. At the same time the mounting should be able to accommodate different sized antennas and different types and sizes of cable connections.

SUMMARY OF THE INVENTION

It is accordingly an object of the present invention to provide an improved mounting for an antenna onto a vehicle.

Yet a further object of the present invention is to provide a mounting for an antenna which can position the antenna on the roof of a vehicle.

A further object of the present invention is to provide a roof mount for an antenna which capacatively couples the antenna to the vehicle thereby avoiding the necessity of puncturing the vehicle to provide a ground connection.

Still another object of the present invention is to provide an antenna roof mount for vehicles which can be easily attached and/or removed from the vehicle without leaving a damaged vehicle.

Still a further object of the present invention is to provide a mounting for an antenna onto a vehicle which can accommodate different sized antennas and different types of electrical cables for feeding the antenna.

A further object of the present invention is to provide an antenna roof mount for vehicles which provides sufficient capacative coupling between the antenna and the vehicle for providing a suitable ground connection for the antenna.

Yet a further object of the present invention is to provide a mounting for an antenna which can easily be connected to the roof of a vehicle without the need of skilled labor or complex equipment.

Briefly, the invention provides an antenna roof mount for a vehicle wherein the vehicle includes at least a roof portion. The mount comprises a base plate which can be transversely positioned across the roof. A housing is coupled to the base plate which supports an antenna extending therefrom. The base plate is secured to the roof portion by appropriate mounting means. A coupling means is provided for capacatively coupling the base plate to the roof.

For vehicles containing a vinyl covered roof, the vinyl covering itself can serve as the insulation between the base plate and the roof to provide appropriate capacative coupling therebetween. For vehicles without the vinyl roof covering, the layer of paint has been found sufficient to provide the necessary capacative interconnection between the base plate and the roof.

The housing means contains appropriate knockout opening which can accommodate different size and types of feed through cables. Additionally, the opening for receiving the antenna can be easily adjusted to accommodate different size and types of antennas. The mounting means which secures the base plate onto the roof portion uses simple clamps which hook onto the edge of the roof to provide quick and easy installation and removal of the antenna roof mount.

The aforementioned objects, features and advantages of the invention will, in part, be pointed out with particularity and will, in part, become obvious from the following more detailed description of the invention, taken in conjunction with the accompanying drawing, which forms an integral part thereof.

BRIEF DESCRIPTION OF THE DRAWING

In the drawing.

In the various figures of the drawing, like reference characters designate like parts.

DESCRIPTION OF THE PREFERRED EMBODIMENT

Figure 1:
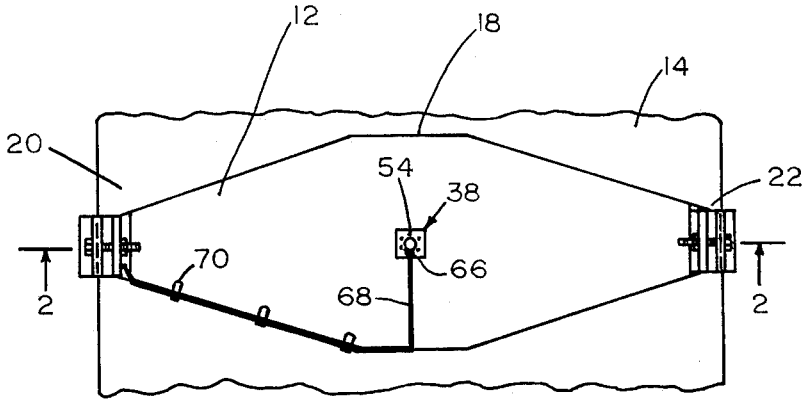
FIG. 1 shows a top view of the antenna roof mount positioned transversely across a portion of a vehicle roof.
Figure 2:
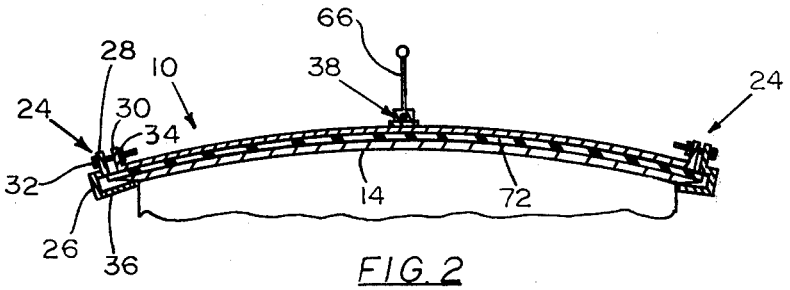
FIG. 2 is a side sectional view taken along line 2—2 of FIG. 1.

Referring now to the drawings, the antenna roof mount is shown generally at 10 and includes a base plate 12 which is formed to extend transversely across the roof top 14 of a vehicle shown generally at 16. The shape of the base plate is formed wider at its center portion 18 and tapers towards the end portions 20 and 22. In this manner the center portion supporting the antenna housing is substantially wider than the antenna housing itself. It is formed with a slight curvature, as best seen in FIG. 2, in order to snugly fit across the roof of the vehicle.

The base plate is securely mounted onto the roof by means of the end clamps shown generally at 24. While any type of clamping arrangement can be utilized, the one shown includes a C-shaped clamp portion 26 with an upwardly extending leg 28 from one of the ends of the clamp. At the end of the base plate there is also provided an upwardly turned lip portion 30. The leg 28 and the lip 30 each includes aligned bore holes which can receive the bolt 32 passing therethrough which is tightened by means of the nut 34.

The base plate is then positioned transversely across the roof. The C-clamps at either end are then placed around the edge of the roof. Typically, it is placed around the roof gutter with the lower leg 36 of the C-clamp extending into the door opening of the vehicle. By means of the nut and bolt 32, 34, the base plate is then tightened onto the roof and securely positioned onto the vehicle roof.

Figure 3:
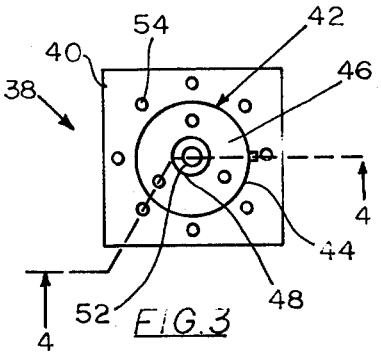
FIG. 3 is a top view of the housing means which supports the antenna and is mounted onto the base plate.
Figure 4:
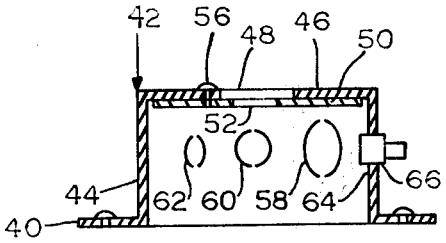
FIG. 4 is a side sectional view taken along lines 4—4 of FIG. 3.
Figure 5:
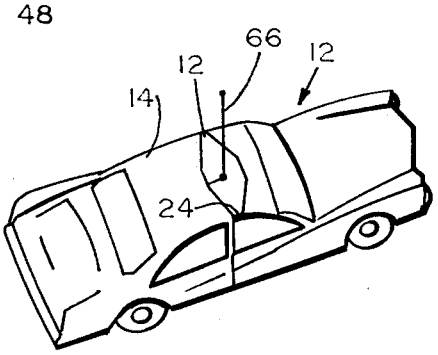
FIG. 5 is an isometric view of a vehicle having the improved antenna roof mount of the present invention connected thereto.

Bolted to the proximate center of the base plate 12 is a housing 38 which includes a lower plate 40 of approximately square configuration, as best seen in FIG. 3 and an upwardly extending mounting cup 42 at best seen in FIG. 4. The mounting cup includes side walls 44 and a top wall 46 with an opening 48 positioned therein. Beneath the top wall is bolted an additional plate 50 having an opening 52 which is smaller than the opening 48. A series of bolts 54 secure the housing 38 onto the base plate, and bolts 56 secure the plate 50 to the upper portion 46 of the mounting caps. Formed in the walls 44 are a series of knockout openings 58, 60, 62 each of different size and configuration. Through one of these openings 64 is positioned a feed through connection 66 which can accommodate a cable extending from the antenna.

Secured within the housing 38 is an upwardly extending antenna 66 which fits through the openings 48, 52 in the top of the housing 38. A cable 68 extends through the feed through device 66 and along the top of the base plate until it reaches the edge. It then is retained against the edge of the base plate by means of hooks 70. At its end it can continue around the edge of the vehicle into the vehicle itself.

The antenna roof mount as described can accommodate various sized antennas as well as various sized cables. Additionally, it does not necessitate forming any holes in the vehicle itself but can be easily mounted and removed as desired without marring the appearance of the vehicle.

Specifically, in connection with the ease of mounting, there is generally provided an opening directly into the vehicle for which the antenna is positioned. This opening provides a passageway for the cable from the antenna, and also provides a means for grounding the antenna to the vehicle. By means of the base plate, the need for making a hole in the vehicle is eliminated. It should be noted that the base plate is generally formed of a conductive material, such as steel or other similar metal. The vehicle roof 14 is also formed of conductive material such as steel. The entire roof may be formed of a unitary piece of metal or at least a metallic frame it utilized on which is placed a vinyl cover. Such a vinyl cover is shown at 72 placed over the metallic roof 14. The metal base plate with the metallic roof and the insulating vinyl material therebetween form a capacative coupling between the base plate and the vehicle. With the antenna conductively coupled to the base plate, there is provided a capacative coupling for grounding the antenna to the vehicle without the need of making a hole into the vehicle.

In those models which do not include a vinyl over on the vehicle roof, it has been found that the layers of paint, typically formed of a lacquer material, forms sufficient insulation between the metallic base plate and the metallic roof to provide the necessary capacative effect between the base plate and the roof in order to capacatively ground the antenna.

Because of the capacative coupling, an opening in the vehicle for grounding the antenna is eliminated. The active cable connected to the antenna also need not pass through an opening formed in the vehicle but can instead pass around the edge of the base plate and into the vehicle without the need of a hole. Alternately, such a hole could be provided at the edge where it would be inconspicious. Because of the avoidance of making a hole in the vehicle, while at the same time appropriately mounting the antenna and providing a suitable gound connection, the antenna can be easily removed or replaced without fear of leaving a marred vehicle. Heretofore, when an antenna has been removed entirely from the vehicle, the opening formed in the vehicle would remain. Alternately, if a different style of antenna were utilized, it would often not fit into the previously formed opening and a separate opening would have to be made which would leave the first opening as a permanent mark on the vehicle. This is avoided by means of the improved antenna mount. The base plate can easily be installed or removed without leaving any marks on the vehicle and yet appropriate ground connection is provided.

Because of the housing means 38, different size and style of antennas can be easily accommodated. While a single opening 48 is provided in the top of the mounting cap, different plates 50 can be easily bolted to provide an appropriate opening to receive the antenna.

Generally, the opening 48 would be the largest to accommodate the largest size antenna. A series of plates 50 would be available for easy installation in the mounting cap to provide smaller openings to accommodate smaller size and styles of antennas. Therefore, the antenna selected can be utilized with the antenna roof mount provided, despite the type of antenna utilized. Additionally, should an antenna be changed to a different type, the same roof mount can still be utilized and only the plate 50 need be changed to provide a different sized opening to accommodate the new antenna.

Generally, the antennas come with different types of feed through cables which would require different size of mounting means to hold the cable. By means of the plurality of knockout holes, each of the different types of feed through connections and cables can be accommodated. The appropriate hole is knocked out to accommodate the size of the cable and cable mounts of an assortment made available, while the others are retained closed. However, should one change the type of cable, all that is needed is to knock out an additional type of hole and it can be easily installed.

It should be recognized that because of the clamps at the edge of the base plate, the entire roof mount can be easily installed and removed without the need of special equipment or special skilled labor. It can be changed from one vehicle to another vehicle and avoid marring the vehicle upon its installation.

There has been disclosed heretofore the best embodiments of the invention presently contemplated. However, it is to be understood that various changes and modifications may be made thereto without departing from the spirit of the invention.

I claim:

1. An antenna roof mount for a vehicle having a roof portion with a thin integral layer of dielectric material existing on the roof portion which serves as the decorative coating of the roof portion, said roof mount comprising:

a base plate for transverse positioning across said roof portion; said base plate being nonconductively attached to said roof portion;

housing means coupled to said base plate, said base plate being substantially wider than said housing means, at least in the area of coupling between said housing means and said base plate, and of sufficient size to provide capacitive coupling between an antenna and the vehicle to provide a suitable ground connection for the antenna;

antenna means supported by and extending from said housing means; a coaxial cable having an outer conductor connected to said housing means and an inner conductor connected to said antenna; and mounting means for securing said base plate directly onto said integral dielectric material on the roof portion without any further dielectric material therebetween whereby the integral dielectric material also serves as coupling means for capacatively coupling said base plate to said roof portion.

2. An antenna roof mount as in claim 1 and wherein said dielectric material comprises a vinyl roof covering.

3. An antenna roof mount as in claim 1 and wherein said dielectric material comprises a layer of paint on said roof portion.

4. An antenna roof mount as in claim 1 and wherein said dielectric material capacatively grounds said antenna to said vehicle, and further comprising cable means electrically connected to said antenna and capable of connection to a transceiver means in the vehicle and fastening means attaching said cable means alongside of said base plate.

5. An antenna roof mount as in claim 1, and wherein said base plate extends almost entirely across said roof portion and said mounting means comprises and clamps for clamping said base layer to the edges of said roof portion.

6. An antenna roof mount as in claim 5 and wherein said base plate comprises upwardly extending flanges at the remote ends thereof, and said end clamps are C-shaped clamps capable of hooking over the edges of the roof portion, and fastening means for adjustably interconnecting said C-shaped clamps to said upwardly extending flanges to thereby tighten said base plate onto said roof portion.

7. An antenna roof mount as in claim 1 and wherein said housing means comprises a top wall, a depending perimetric wall, and a flange outwardly extending from the lower end of said perimetric wall, an opening being formed in said top wall to receive said antenna means, cable feed through means in said perimetric wall for receiving a cable coupled to said antenna, and fastening means for connecting said flange to said base plate.

8. An antenna roof mount as in claim 7 and wherein said perimetric wall comprises a plurality of spaced apart knock out openings, each opening capable of receiving a different type of cable feed through means.

9. An antenna roof mount as in claim 7 and further comprising plate means having an opening therein smaller than the opening in said top wall, and means for securing said plate means to said top wall, whereby the sizes of said openings can be appropriately adjusted to receive different sized antennas.

* * * * *